US007367700B2

(12) United States Patent
Chasmar

(10) Patent No.: US 7,367,700 B2
(45) Date of Patent: May 6, 2008

(54) SAFETY WHIP MAST

(76) Inventor: Michael Chasmar, 1224 Gatling Ct., Vista, CA (US) 92083

( * ) Notice: Subject to any disclaimer, the term of this patent is extended or adjusted under 35 U.S.C. 154(b) by 0 days.

(21) Appl. No.: 11/375,752

(22) Filed: Mar. 15, 2006

(65) Prior Publication Data

US 2006/0207493 A1 Sep. 21, 2006

Related U.S. Application Data

(60) Provisional application No. 60/594,209, filed on Mar. 18, 2005.

(51) Int. Cl.
*F21V 9/16* (2006.01)

(52) U.S. Cl. ..... 362/473; 362/84; 362/431; 116/173

(58) Field of Classification Search ..... 362/473, 362/396, 84, 431; 116/173; 280/200; 40/593
See application file for complete search history.

(56) References Cited

U.S. PATENT DOCUMENTS 3,967,575 A * 7/1976 Coutts ..... 116/35 A
4,088,882 A * 5/1978 Lewis ..... 362/217
4,099,535 A * 7/1978 Hubachek ..... 135/66
4,633,215 A * 12/1986 Anders et al. ..... 340/473
4,876,981 A * 10/1989 Barnhart ..... 116/173
5,881,481 A * 3/1999 Bashaw et al. ..... 40/593
6,057,787 A * 5/2000 Kell et al. ..... 340/984
6,129,035 A * 10/2000 Schweinberger ..... 116/28 R
6,558,018 B1 * 5/2003 Blum ..... 362/183
7,018,066 B2 * 3/2006 Kirven ..... 362/249
7,091,843 B1 * 8/2006 Lal ..... 340/468
2006/0198154 A1 * 9/2006 Naylor ..... 362/473

* cited by examiner

*Primary Examiner*—Ali Alavi
*Assistant Examiner*—Evan Dzierzynski
(74) *Attorney, Agent, or Firm*—Loza & Loza, LLP; Christina Loza

(57) ABSTRACT

At least one embodiment of the invention pertains to a whip mast including a rod, a flag at one end of the rod and a luminescent element wound or spiraled around the rod. The luminescent element may be coupled to the rod to provide illumination, light, and/or glow to enhance the appearance and/or visibility of the whip mast to alert other people or vehicles of its presence. The luminescent element may include an electrical interface to bring power to the luminescent element. The whip mast may be securely coupled to a vehicle by using a fastener or mounting device.

2 Claims, 4 Drawing Sheets

SAFETY WHIP MAST

CLAIM OF PRIORITY UNDER 35 U.S.C. §119

The present U.S. patent application claims priority to Provisional Application No. 60/594,209 entitled "Electroluminescent Wire Wrapped Around A Flexible Rod with Safety Flag Attached to End of Rod", filed Mar. 18, 2005.

FIELD

Various embodiments of the invention pertain to warning or safety devices. At least one embodiment of the invention pertains to an illuminated, flexible safety whip mast that serves as a warning to others when placed on a vehicle.

BACKGROUND

Safety flags and whip masts are commonly used on off-road vehicles to warn other drivers of the vehicle's presence. In fact, many off-road terrains legally require whip masts to be used to warn other drivers and prevent accidents. Typically, whip masts are eight to ten feet in length, are attached to the vehicle, and have a flag on the top to warn others. Although conventional whip mast flags may be effective to warn others during the daytime, their usefulness is very limited during twilight or darkness since its visibility is impaired. In sand dunes, and other off-road terrains, simple driving lights on the vehicles are often insufficient to warn others of the presence of a vehicle in the vicinity. As such, accidents may occur. In an open, off-road vehicle, accidents can be particularly lethal. Accordingly, a whip mast and/or flag are needed that can warn others in both daylight and darkness conditions.

SUMMARY OF THE INVENTION

One embodiment of the invention pertains to a whip mast comprising a fiberglass rod, a flag coupled at a first end of the rod, a luminescent element coupled to the rod and extending along a longitudinal portion of the rod. The luminescent element may be coiled around the rod and coupled to the rod by a heat shrink wrap tubing over the luminescent element. In another embodiment of the invention the rod may be hollow and the luminescent element is enclosed in the hollow portion of the rod.

The whip mast may also have a controller electrically coupled to the luminescent element to control the operation of the luminescent element. The controller may control the power source to cause the luminescent element to either blink, flash, or produce alternating or rolling light patterns. In various embodiments of the invention, the power source may be kinetic energy transducer mounted on the rod that generates energy to power the luminescent element as the rod moves.

In alternate embodiment of the invention, the whip mast may have a telescoping rod including a plurality of segments that can be expanded or compressed to a desired length. The luminescent element expands and compresses with the telescoping rod. In some implementations, the whip mast may include a plurality of foldable segments that are coupled together along hinge points.

In some implementations an electrical interface couples the luminescent element to a power source in order to power the luminescent element. The luminescent element may include an electroluminescent wire, one or more light emitting diodes, or a fluorescent paint. Additionally, the luminescent element may extend along a longitudinal segment of the rod. The whip mast may also include a second luminescent element coupled to the first end of the rod for additional illumination.

One embodiment of the invention pertains to a whip mast for vehicles comprising means for supporting a flag on a vehicle, integrated means for generating light along a longitudinal portion of rod, means for providing power to generate the light, and means for controlling the light generated. The whip mast may further include means for extending and compressing the whip mast.

DETAILED DESCRIPTION

In the following description numerous specific details are set forth in order to provide a thorough understanding of the invention. However, one skilled in the art would recognize that the invention might be practiced without these specific details. In other instances, well known methods, procedures, and/or components have not been described in detail so as not to unnecessarily obscure aspects of the invention.

In the following description, certain terminology is used to describe certain components and features of one or more embodiments of the invention. For example, the term "mast" and/or "whip mast" includes, but is not limited to, a flexible, semi-flexible, or rigid pole, shaft, rod, or staff. The term "flag" includes, but is not limited to, a banner, warning sign, and/or ensign. The term "luminescent element" refers to all forms of illumination including, but is not limited to, electroluminescent wire or filament, a fiber optic element, a plurality of light emitting diodes, gas filled tubing (e.g., neon light, fluorescent light, etc.), electrofluorescent paint, glow in the dark material or paint, and other light source or reflection elements, etc.

Figure 1:
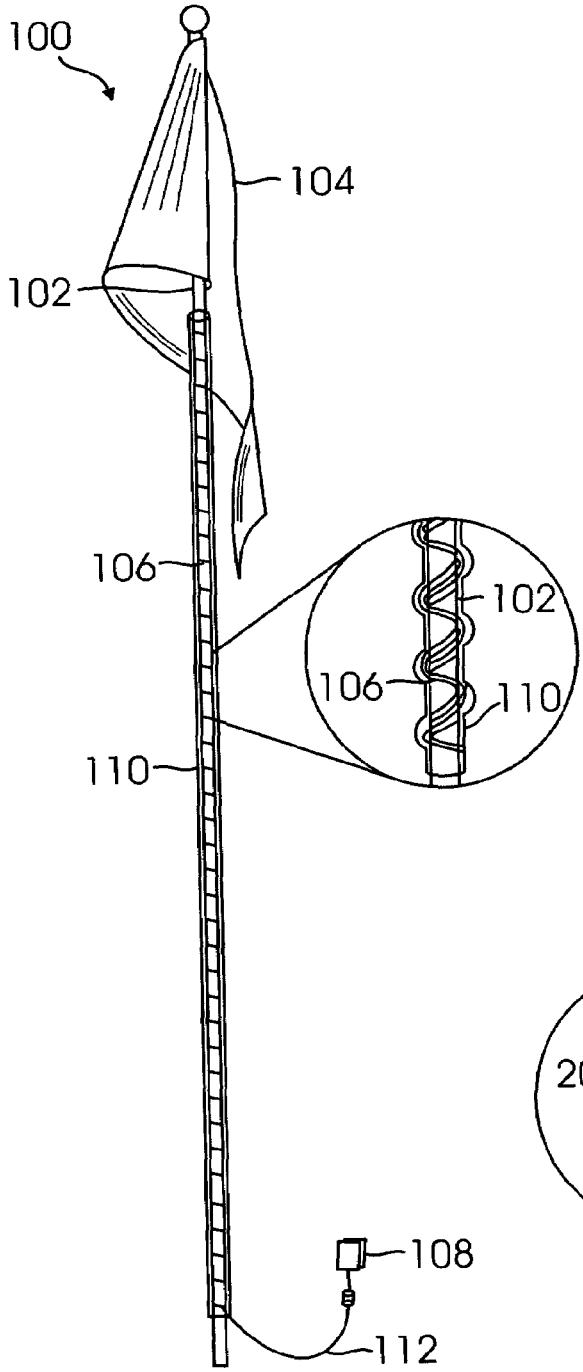
FIG. 1 illustrates a whip mast including a rod, a flag at one end of the rod, and a luminescent element spiraled around the rod according to one embodiment of the invention.

FIG. 1 illustrates a whip mast 100 including a rod 102, a flag 104 at one end of the rod 102, and a luminescent element 106 wound or spiraled around the rod 102 according to one embodiment of the invention. In various configurations, the rod 102 may have a solid composition, a hollow composition, and/or include multiple layers of materials. Preferably, the rod 102 may be made of a flexible material such as plastic, fiberglass, metal wire, composite materials, etc., which allows it to flex with motion. However, in other implementations, the rod 102 may be rigid or inflexible.

In various embodiments of the invention, the rod 102 may have a composition, stiffness, and/or diameter that can support the luminescent element 106 such that the rod 102 withstands the velocity and movement of the vehicle without snapping. For example, depending on the application, the rod may be a one quarter inch to three (3) inches in diameter. The rod 102 is used to achieve a proper height for the flag 104 thus creating greater visibility of the vehicle to which the whip mast 100 may be attached. For instance, depending on the application, the rod 102 may have a length of between four to twelve feet.

The flag 104 may be of a bright or neon color, such as red, yellow, or orange, so as to bring attention to the vehicle on which it is mounted. This may serve to warn other vehicles or people of the location of the whip mast-bearing vehicle. In other implementations, the flag 104 may include images and/or a combination of different colors, shapes, and sizes. The flag 104 may be made of a rigid, semi-rigid, and/or flexible material depending on the usage or desired implementation.

The luminescent element 106 may be coupled to the rod 102 to provide illumination, light, and/or glow to enhance the appearance and/or visibility of the whip mast 100 to alert other people or vehicles of its presence. The luminescent element 106 may extend along a longitudinal portion, length, or segment of the rod 102 to provide increased visibility to the whip mast 100. This feature is particularly, but not exclusively, useful in darkened environments. In various implementations, the luminescent element 106 may be a electroluminescent wire or filament, a fiber optic element, a plurality of light emitting diodes, gas filled tubing (e.g., neon light, fluorescent light, etc.), electrofluorescent paint, glow in the dark material or paint, etc. The luminescent element 106 may cover parts, segments, or the entire length of the rod 102.

The luminescent element 106 may be attached or coupled to the rod 102 in various different ways. For example, it may wound around the rod 102, glued or attached to the rod, and/or inserted inside or between layers of the rod 102. In one embodiment, illustrated in FIG. 1, the luminescent element 106 is wound around the rod 102 and coupled to it by using a clear heat shrink wrap tubing 110 over the luminescent element 106 and rod 102. The luminescent element 106 may have any bright color including but not limited to pink, green, blue, red, yellow, purple, or any other bright or neon color to bring additional attention to the vehicle to which the whip mast 100 is attached.

In some implementations, the whip mast 102 may have an internal or external power source to cause it to illuminate, emit light, or glow. For instance, the luminescent element 106 includes an electrical interface (e.g. wire) 112 to bring power to the luminescent element 106. Depending on the implementation, the electrical interface 112 may be coupled to different types of power supply, such as a vehicle's power source, a separate battery pack 108, and/or other power sources. One feature provides for an automatic power generation device, such as a kinetic energy transducer. The automatic power generation device may be mounted on the whip mast 100 such that it generates power as the whip mast 100 sways and moves during operation of the vehicle on which the whip mast 100 is mounted.

In some implementations, a controller may be electrically coupled to the electrical interface 112, the luminescent element 106, and/or a power source to control the power to and/or operation of the luminescent element 106. Such controller may be coupled to may include a switch, an electrical circuit, a processing device, etc., and be located on or external to the whip mast 100. In one example, the controller includes a circuit that controls the power to the luminescent element 106 to cause it to blink, flash, strobe, produce alternating or rolling light patterns, and/or varying light colors and/or intensity depending on the mode of operation. In other implementations, the controller may be manually activated or operated by a user or automatically operated according to a set of commands, instructions, and/or configurations.

The whip mast 100 may be securely coupled to a vehicle by using a fastener or mounting device. In various implementations, the whip mast 100 may be secured at a second end of the whip mast 100 or any other part of the whip mast 100. In one example, the whip mast 100 may be coupled to a vehicle using a quick release mounting application, so that the whip mast 100 may be moved from vehicle to vehicle easily and efficiently.

Figure 2:
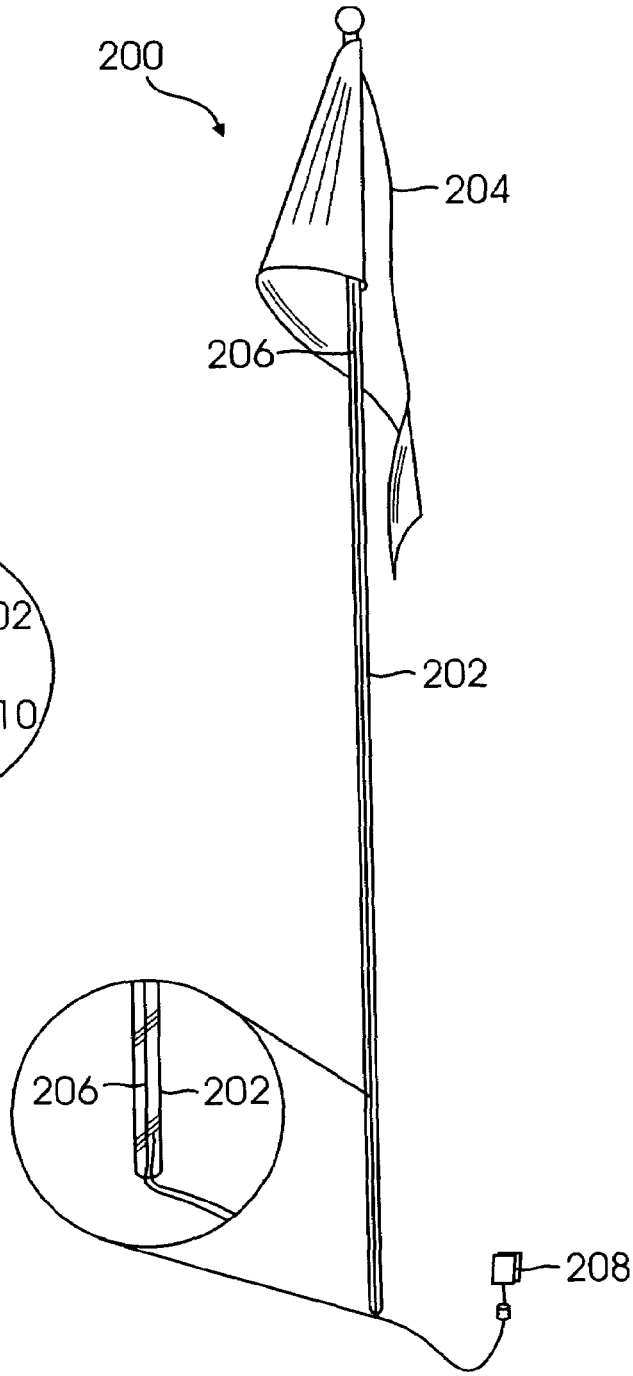
FIG. 2 illustrates a whip mast including a rod, a flag at one end of the rod, and a luminescent element inside the rod according to one embodiment of the invention.

FIG. 2 illustrates a whip mast 200 including a rod 202, a flag 204 at one end of the rod 202, and a luminescent element 206 inside the rod 202 according to one embodiment of the invention. In a preferred embodiment, the rod 202 has a hollow composition so that it can enclose the luminescent element 206. In various implementations, the rod 202 may be made of a clear or translucent material so has to allow the light or glow from the luminescent element 206 to emit from the rod 202. One feature provides for the rod 202 being made of, or including, a material that can protect the luminescent element 206 from wind, rain, rough terrain, and other elements or environmental conditions.

In some implementations, the luminescent element 206 may be an electroluminescent wire, a fiber optic element, a plurality of light emitting diodes, etc. The luminescent element 206 may cover only parts, segments, or the entire length of the rod 202. The luminescent element 206 may be activated by an electrical signal, voltage, magnetic field, and/or chemical reaction to cause light to be emitted. In some embodiments, the luminescent element 206 may be a glow in the dark paint and/or material.

Figure 3:
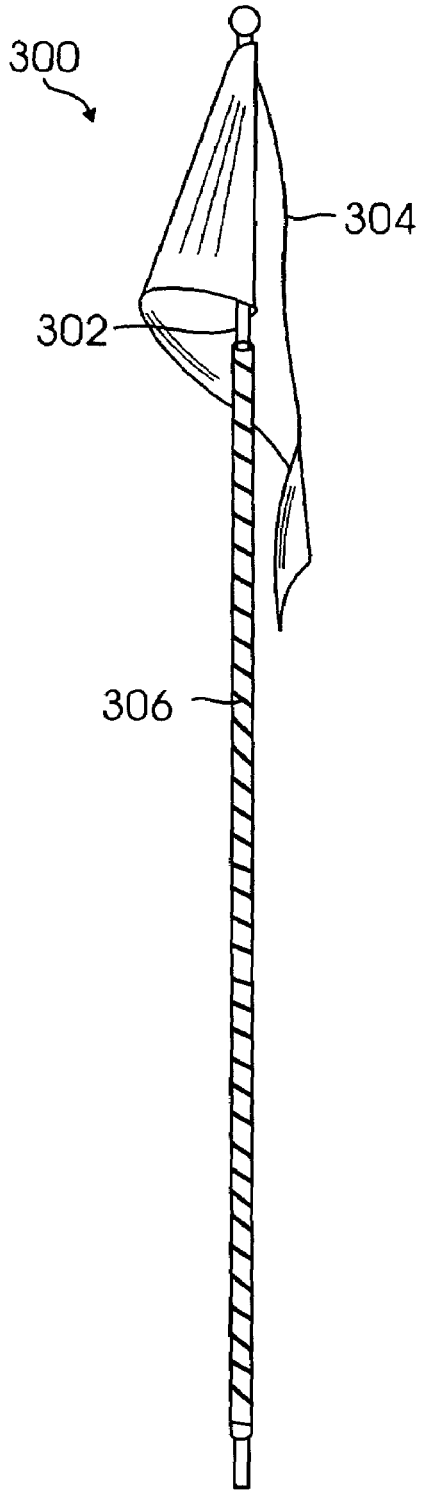
FIG. 3 illustrates a whip mast including a flag and a rod that is treated with electrofluroscent paint according to one embodiment of the invention.

FIG. 3 illustrates a whip mast 300 including a flag 304 and a rod 302 that is treated with electrofluoroscent paint 306 according to one embodiment of the invention. In various configurations the rod 302 may have a solid composition, a hollow composition, and/or include multiple layers of materials. One feature provides for the rod 302 to be colored, painted, or dipped in its entirety, partially, striped, or with various designs. For example, the rod 302 could be treated with electrofluorescent paint, glow in the dark material or paint such that certain areas on or in the rod would glow or reflect light without the need for a power source of any kind.

Figure 4:
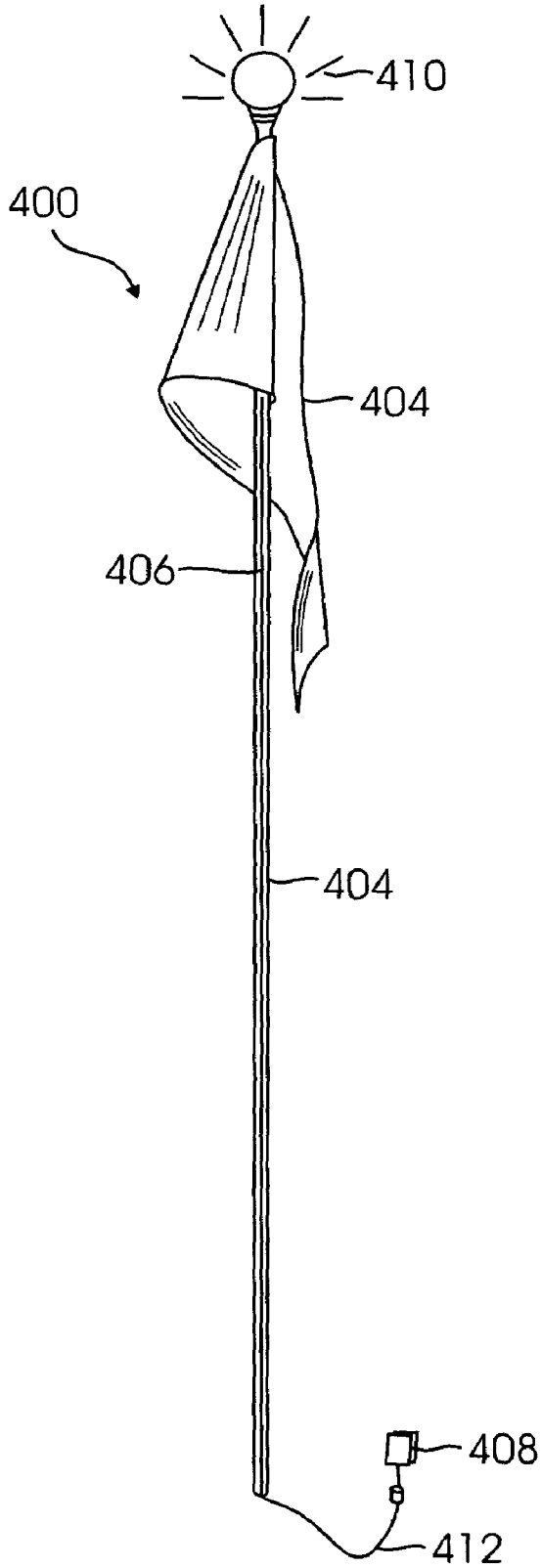
FIG. 4 illustrates a whip mast including a rod, a flag at a first end of the rod, a luminescent element inside the rod, and an additional light source according to one embodiment of the invention.

FIG. 4 illustrates a whip mast 400 including a rod 402, a flag 404 at a first end of the rod 402, a luminescent element 406 inside the rod, and an additional light source 410 according to one embodiment of the invention. The luminescent element 406 may be spiraled around the rod 402 as set forth in FIG. 1 above. In various configurations, the whip mast 400 may include an additional light source 410, such as a light bulb or LED, at the first end of the rod 402. The additional light source 410 may serve to provide additional warning to oncoming vehicles or people in the vicinity of the whip mast-bearing vehicle. In another feature of the invention, the flag 404 itself may be embedded with or include various LEDs, lights, or fiber optic fibers to produce additional illumination. This additional light source 410 may be operated either independent of, or in synchronization with, the luminescent element 406. The luminescent element 406 may include an electrical interface (e.g. wire) 412 to bring power to the luminescent element 406. Depending on the implementation, the electrical interface 412 may be coupled to different types of power supply, such as a vehicle's power source, a separate battery pack 108, and/or other power sources and/or controllers.

Figure 5:
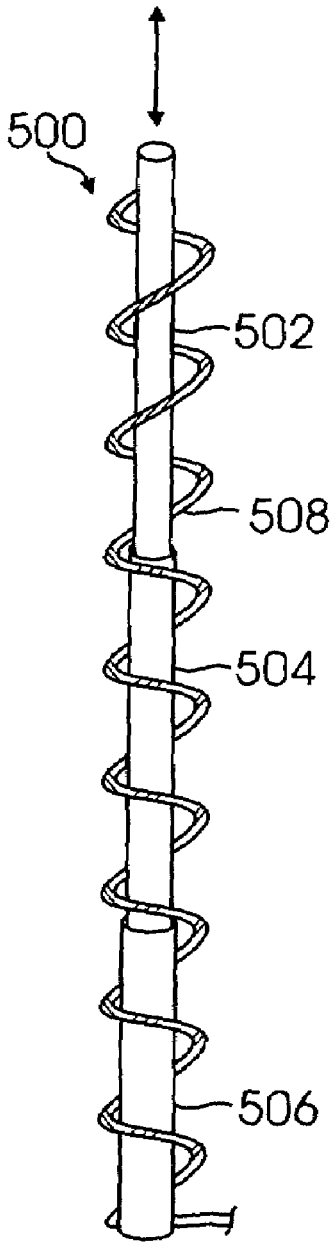
FIG. 5 illustrates a telescoping whip mast according to one embodiment of the invention.

FIG. 5 illustrates a telescoping whip mast 500 according to one embodiment of the invention. The whip mast 500 may include a plurality of telescoping segments, 502, 504 and 506, that enables the whip mast 500 to be compressed in size or extended to its full length. Each telescoping segment 502, 504, and 506, may be maintained at a particular position by friction or by other fastening means. The telescoping feature of the whip mast 500 permits it to be stored, shipped, or sold in a compressed size, thereby saving space. Additionally, the telescoping whip mast 500 may be extended to its maximum length or some intermediate length as desired. Such feature also permits a user to compress the whip mast 500 when a vehicle on which it is used is transported or stored.

In one implementation, the telescoping whip mast 500 may include a glow in the dark painted surface or material that makes the whip mast 500 standout or be more visible when extended. In another implementation, a luminescent element is coiled or spiraled 508 around the rod of the telescoping whip mast 500 and coupled at a first end and a second end with the remaining portions of the coiled luminescent element 508 being free to compress and expand as the telescoping whip mast 500 is compressed or expanded.

In other variations, the whip mast may include a plurality of segments that can be folded along hinge points. A sleeve or collar may slide over the hinge points to keep the whip mast from folding when it is extended. Such folding rod allows a user to reduce or compress the length of the whip mast for storage or shipping and to expand it during use.

Figure 6:
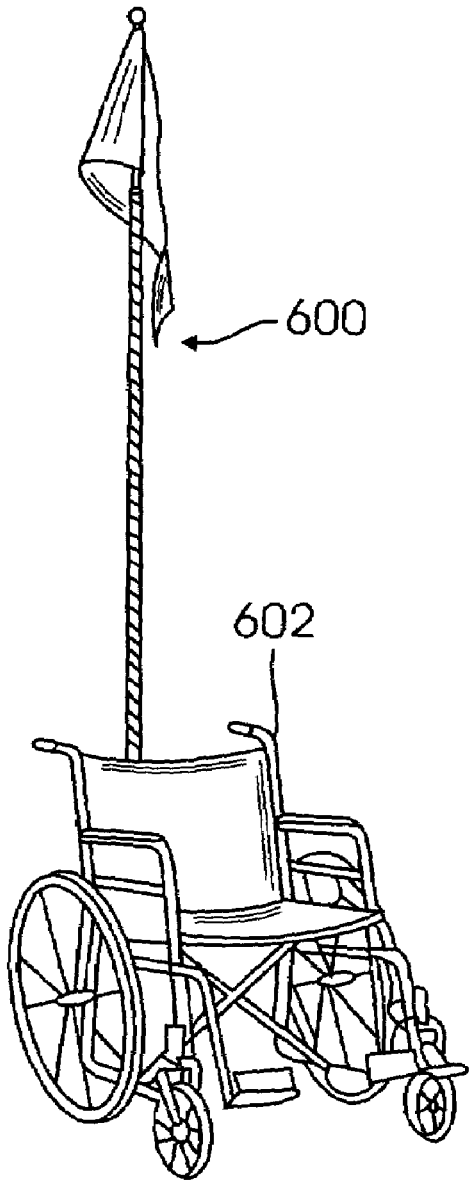
FIG. 6 illustrates use of the whip mast with a wheelchair.
Figure 8:
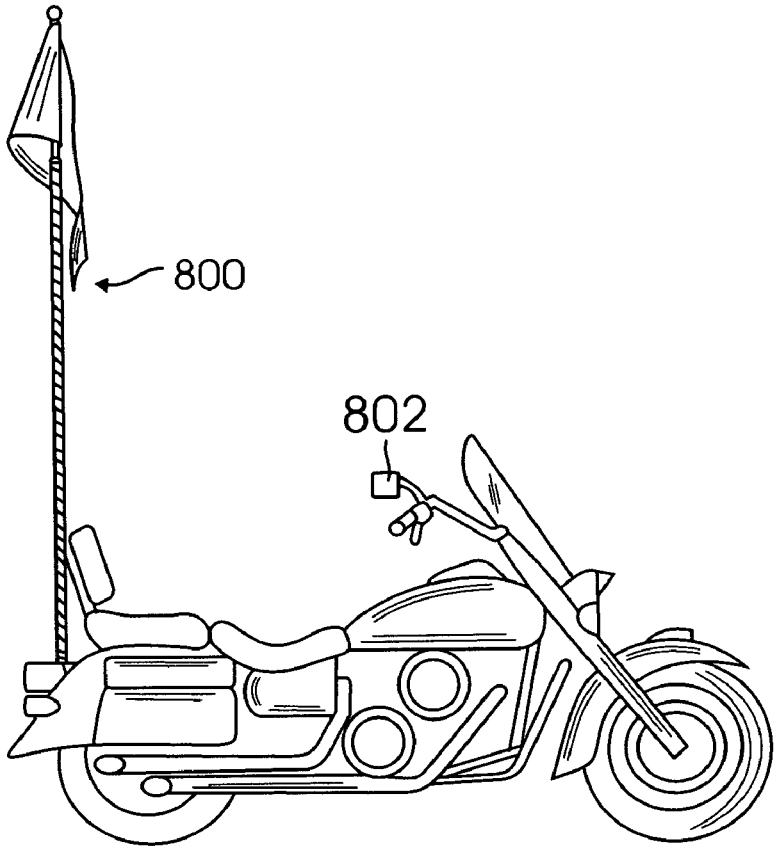
FIG. 8 illustrates use of the whip mast with a motorcycle.
Figure 7:
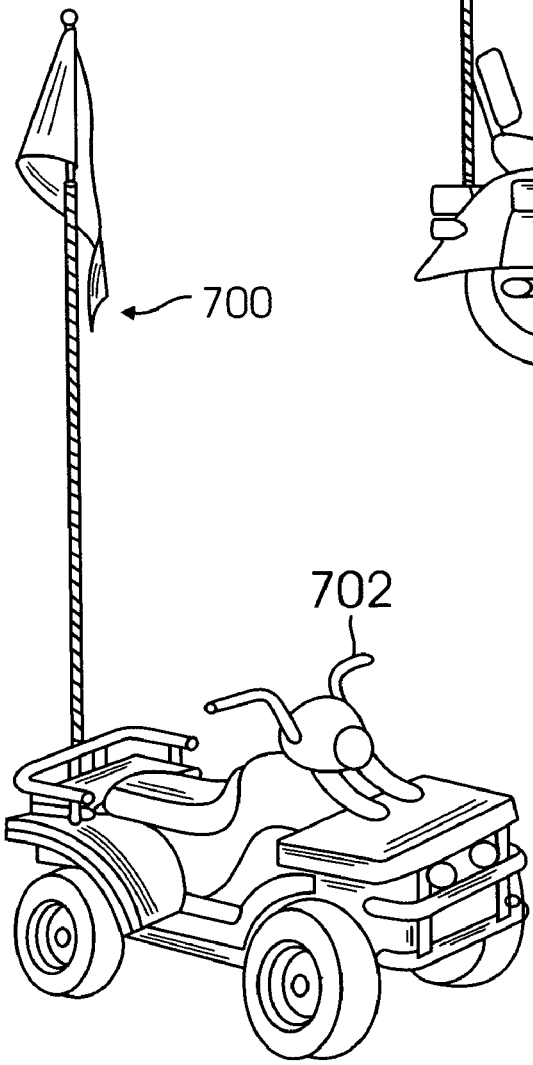
FIG. 7 illustrates use of the whip mast with an all terrain vehicle.

FIGS. 6, 7 and 8 show various types of vehicles on which the whip mast 600, 700, and 800 may be used. The whip mast 600 may be used on a wheel chair 602 to provide warning to pedestrians and vehicles on roads, highways, and even in shopping markets. The whip mast 700 may be used with off-road vehicles such as all terrain vehicles (ATVs) 702, trucks, jeeps, dune buggies, sand rails, quads, mini-buggies, off highway vehicles (OHVs), bikes, all terrain cycles (ATCs), motorcross bikes, and various camping and storage vehicles such as toy box trailers, toy haulers, enclosed trailers, fifth wheel trailers, trailers, recreational vehicles (RVs), and motorhomes. In another embodiment of the invention, the whip mast 800 may also be used on various vehicles found on the road such as motorcycles 800, scooters, automobiles, trucks, sports utility vehicles, trailers, motorhomes, and the like.

One or more of the components and functions illustrated in FIGS. 1, 2, 3, 4, 5, 6, 7 and/or 8 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A whip mast consisting of:

a flexible mast-like rod;

a flag coupled at a first end of the rod; and a luminescent element coiled around the rod, extending along a longitudinal portion of the rod, and wherein the luminescent element is secured to the rod by a heat shrink wrap tubing over the luminescent element.

2. A whip mast for vehicles consisting of:

a flexible mast-like fiberglass rod;

a flag coupled at a first end of the rod;

a bendable luminescent element coiled around the rod, extending along a longitudinal portion of the rod, wherein the luminescent element is secured to the rod by a heat shrink wrap tubing over the luminescent element;

a power source electrically coupled to the luminescent element;

a controller to control the operation of the luminescent element;

a second luminescent element coupled at the first end of the rod;

wherein the controller controls the power source to cause the luminescent element to either blink, flash, or produce alternating or rolling light patterns; and wherein the power source is a kinetic energy transducer mounted on the rod that generates energy to power the luminescent element as the rod moves.

* * * * *